US007708619B2

(12) United States Patent
Subramanian et al.

(10) Patent No.: US 7,708,619 B2
(45) Date of Patent: May 4, 2010

(54) METHOD FOR GRINDING COMPLEX SHAPES

(75) Inventors: Krishnamoorthy Subramanian, Lexington, MA (US); John A. Webster, Storrs, CT (US); Peter Caputa, IV, Marlborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 500 days.

(21) Appl. No.: 11/439,510

(22) Filed: May 23, 2006

(65) Prior Publication Data

US 2007/0275641 A1 Nov. 29, 2007

(51) Int. Cl.
*B24B 1/00* (2006.01)

(52) U.S. Cl. ..... 451/11; 451/28; 451/53; 451/57

(58) Field of Classification Search ..... 451/9, 451/10, 11, 28, 53, 54, 57, 58, 69, 70
See application file for complete search history.

(56) References Cited

U.S. PATENT DOCUMENTS

| | | | | |
|---|---|---|---|---|
| 4,929,130 | A | 5/1990 | Diebolt et al. | |
| 5,177,901 | A | 1/1993 | Smith | |
| 5,203,081 | A | 4/1993 | Campbell | |
| 5,205,081 | A | 4/1993 | Kuehne et al. | |
| 5,330,326 | A | 7/1994 | Kuehne et al. | |
| 5,398,455 | A | 3/1995 | Slavin et al. | |
| 5,430,936 | A | 7/1995 | Yazdzik, Jr. et al. | |
| 5,484,327 | A * | 1/1996 | Kovach | 451/49 |
| 5,738,696 | A | 4/1998 | Wu | |

(Continued)

FOREIGN PATENT DOCUMENTS

EP 0 395 087 A2 10/1990

(Continued)

OTHER PUBLICATIONS

Reis, D.D., et al., "The machining of aluminium alloy 6351," *Proc. IMechE,* vol. 219, Part B: J. Engineering Manufacture, pp. 27-33, (2005).

(Continued)

*Primary Examiner*—Eileen P. Morgan
(74) *Attorney, Agent, or Firm*—Larson Newman & Abel, LLP; Mike W. Crosby

(57) ABSTRACT

A method of producing a complex shape in a workpiece includes the steps of: i) grinding a workpiece at a maximum specific cutting energy of about 10 Hp/in$^3$·min with at least one bonded abrasive tool, thereby forming a slot in the workpiece; and ii) grinding the slot with at least one mounted point tool, thereby producing the complex shape in the slot. The bonded abrasive tool includes at least about 3 volume % of a filamentary sol-gel alpha-alumina abrasive grain having an average length-to-cross-sectional-width ratio of greater than about 4:1 or an agglomerate thereof. A method of producing a slot in a metallic workpiece having a maximum hardness value of equal to, or less than, about 65 Rc includes the step of grinding the workpiece with a bonded abrasive tool at a material removal rate in a range of between about 0.25 in$^3$/min·in and about 60 in$^3$/min·in and at a maximum specific cutting energy of about 10 Hp/in$^3$·min.

18 Claims, 2 Drawing Sheets

U.S. PATENT DOCUMENTS

| | | | | |
|---|---|---|---|---|
| 5,738,697 | A | 4/1998 | Wu et al. | |
| 6,123,606 | A | 9/2000 | Hill et al. | |
| 6,619,890 | B2 | 9/2003 | Hill | |
| 6,669,118 | B2 | 12/2003 | Webster | |
| 6,739,960 | B2 | 5/2004 | Sauer | |
| 6,767,168 | B2 | 7/2004 | Miller | |
| 6,883,234 | B2 | 4/2005 | Packman et al. | |
| 2003/0194947 | A1 | 10/2003 | Bright et al. | |
| 2004/0064944 | A1 | 4/2004 | Packman et al. | |
| 2004/0087256 | A1 | 5/2004 | Schwartz et al. | |
| 2007/0020434 | A1 * | 1/2007 | Thomas | 428/138 |

FOREIGN PATENT DOCUMENTS

| | | | |
|---|---|---|---|
| EP | 1 407 852 | A2 | 4/2004 |
| EP | 1 418 020 | A1 | 5/2004 |
| GB | 2 332 634 | A | 6/1999 |
| WO | 03/086703 | A1 | 10/2003 |

OTHER PUBLICATIONS

Burrows, J.M., et al., "Grinding of Inconel 718 and Udimet 729 Using Superabrasive Grinding Points Mounted on a High Speed Machining Centre," *Proc. of 33rd MATADOE conf.,* pp. 447-452, ISBN 1852333235, (2000).

Aspinwall, D.K., et al., "Hybrid High speed machining (HSM): system design and experimental results for grinding/HSM and EDM/HSM," *Annals of CIRP,* 50(i), pp. 145-148, (2001).

Dewes, R.C., et al., "High speed machining—multi-function/hybrid systems," *Proceedings of the 4th International Conference on Industrial Tooling,* Southhampton, UK, pp. 91-100, (2001).

Burrows, J.M., et al., "Use of High Speed Machining Center for the CBN and Diamond Grinding of Nickel-Based Superalloys,", *Kluer Academic/Plenum Publishers,* ISBN 0306467259, pp. 267-275, (2002).

Soo, S.L., et al., "Point grinding of nickel-based superalloys", *Industrial Diamond Review,* pp. 109-112, 115-116, (Feb. 2002).

Salmon, S., "Creep-Feed Grinding Is Surprisingly Versatile," *Mfg. Eng.,* 133:5 (2004).

"Why More Shops Have Replaced Milling & Broaching with Creep Feed Grinding," *Grinding J.,* pp. 20-28 (Spring 2007).

International Search Report and Written Opinion of the International Searching Authority dated Dec. 11, 2008, from corresponding International Application No. PCT/US2007/012324, filed May 23, 2007.

Invitation to Pay Additional Fees and Partial International Search Report, mailed May 6, 2008, from related International Application No. PCT/US20071012324, filed May 23, 2007.

Malkin, S., "Grinding Technology: Theory and Applications of Machining with Abrasives," Pub: Ellis Horwood ltd., 1st Ed., pp.118-119, 127-129, and 133-137, 1989.

Bhateja, C., et al., "Grinding Theory, Techniques, and Troubleshooting", Pub: Society of Manufacturing Engineers, 1st Ed., Fig. 6, 1982.

Kalpakjian, S., "Manufacturing Engineering and Technology", Pub: Addison-Wesley Publishing Co. Inc., Tables 20.1 and 25.2, 1995, Copyright 1989.

* cited by examiner

METHOD FOR GRINDING COMPLEX SHAPES

BACKGROUND OF THE INVENTION

A re-entrant shape is a form which is wider at the inside than it is at the entrance (e.g., a dovetail joint). Turbine components, such as jet engine, rotors, compressor blade assembly, typically employ re-entrant shaped slots in the turbine disks. The re-entrant shape is used to hold or retain turbine blades around the periphery of turbine disks. Mechanical slides, T-slots to clamp parts on a machine table also use such re-entrant shaped slots.

This type of form cannot generally be created by grinding with a large diameter wheel operated perpendicular to the surface of the part because it would be impossible for the wheel to enter the wider part of the form without removing the narrower part of the form. Typically, broaching or milling has been used in the aerospace industry to produce such a complex shape. Broaching a re-entrant shape, however, is costly partly due to high tooling costs, such as expensive machinery, set-up costs, tooling regrinding costs and slow material removal rates. One of the traditional advantages of broaching over grinding is very low heat generation during the process, which results in good surface integrity. However, this requires frequent tool changes and re-sharpening of dulled cutting edges, which is cost and time intensive. Milling processes are generally very slow, especially in machining difficult-to-machine materials, such as Inconel™ nickel alloy, which is typically used for re-entrant shaped turbine disks of aeroengines. Although high speed milling can be conducted to achieve high efficiency, under such high speeds, fracture of the cutting edge of milling tools commonly occurs, often leading to imbalance, tool fracture and failure of the process.

Conventional broaching, machining and milling processes employ an oil coolant to avoid thermal damage and residual stress to the workpiece. Prior art grinding processes developed to replace machining processes, such as the grinding process described in U.S. Pat. No. 6,883,234 B2, also employ an oil coolant both during formation of slots and during formation of complex shapes. Environmental considerations have led operators to search for processes wherein a water-based coolant can be used in lieu of an oil coolant, while still avoiding thermal damage and residual stress to the workpiece.

Therefore, there is a need to develop new grinding methods to form a complex shape, such as a re-entrant shape, in a workpiece overcoming or minimizing one or more of the shortcomings associated with conventional processes, such as broaching, machining and/or milling processes.

SUMMARY OF THE INVENTION

It has now been discovered that bonded abrasive tools made with a filamentary sol-gel alpha-alumina abrasive grain or an agglomerate thereof, can produce effectively a slot for a re-entrant shape in a workpiece, in particular in a hard-to-grind metallic workpiece, with a high metal removal rate. It also has now been discovered that the slot formation process followed by a complex-shape (e.g., re-entrant shape) formation process with at least one mounted point tool can produce a desired complex shape with a good surface finish in a relatively short process time as compared with that of the conventional milling or broaching process. These processes can be carried out utilizing a water-based coolant in place of traditional oil coolants. Based upon these discoveries, slot formation processes with a bonded abrasive tool to remove the bulk of material for producing a complex shape, and methods for producing a complex shape in a workpiece that employ such a slot formation process are disclosed herein.

In one embodiment, the present invention is directed to a method of producing a complex shape in a workpiece, comprising the steps of: a) grinding a workpiece at a maximum specific cutting energy of about 10 Hp/in$^3$·min (about 27 J/mm$^3$) with at least one bonded abrasive wheel, thereby forming a slot in the workpiece, wherein the bonded abrasive wheel contains at least about 3 volume % of a filamentary sol-gel alpha-alumina abrasive grain having an average length-to-cross-sectional-width aspect ratio of at least 4:1 or an agglomerate thereof; and b) grinding the slot with at least one mounted point tool, thereby producing the complex shape in the slot.

In another embodiment, the present invention is directed to a method of producing a slot in a metallic workpiece having a maximum Rockwell hardness value of equal to, or less than, about 65 Rc. The method comprises the step of grinding the workpiece with a bonded abrasive tool at a material removal rate in a range of between about 0.25 in$^3$/min·in (about 2.7 mm$^3$/sec/mm) and about 60 in$^3$/min·in (about 650 mm$^3$/sec/mm) and at a maximum specific cutting energy of about 10 Hp/in$^3$·min (about 27 W·s/mm$^3$). Alternatively, the method comprises the step of grinding the workpiece with a bonded abrasive tool at a material removal rate in a range of between about 2 mm$^3$/sec/mm and about 700 mm$^3$/sec/mm and at a maximum specific cutting energy of about 30 J/mm$^3$. The slot formation processes of the invention can remove the bulk of material, minimizing the amount of material to be removed in the complex shape grinding processes with a mounted point tool. The slot formation processes of the invention can also reduce the arc of contact of the mounted point tool. In particular, the slot formation processes of the invention, employing a bonded abrasive tool that includes a filamentary sol-gel alumina abrasive grain, have outstanding performance with high metal removal rates and at relatively low specific cutting energies. The low specific cutting energies in turn minimize heat generation in the grinding zone, thus reducing risk of metallurgical damage to workpieces.

The methods of the invention for producing a complex shape that employs such slot formation processes can significantly reduce process costs compared with the conventional processes (e.g., milling and broaching) without compromising surface-finish quality and/or structural integrity of the resultant complex-shaped work product.

BRIEF DESCRIPTION OF THE DRAWINGS

FIG. 3(*b*) is a schematic representation of a complex shape that can be generated by the methods of the invention.

DETAILED DESCRIPTION OF THE INVENTION

The foregoing and other objects, features and advantages of the invention will be apparent from the following more particular description of preferred embodiments of the invention, as illustrated in the accompanying drawings. The drawings are not necessarily to scale, emphasis instead being placed upon illustrating the principles of the invention.

As used herein, the term "complex shape" means a shape or a part that has an angle that is re-entering or pointing inward and which does not allow a mating form to be removed in a direction normal to one of three axes (i.e., x, y or z). An example of the complex shape includes a re-entrant shape. As used herein, the "re-entrant shape" means a shape or a part that has an angle that is re-entering or pointing inward, and is wider at the inside than it is at the entrance. An example of the re-entrant shape is a dovetail slot.

Figure 1:
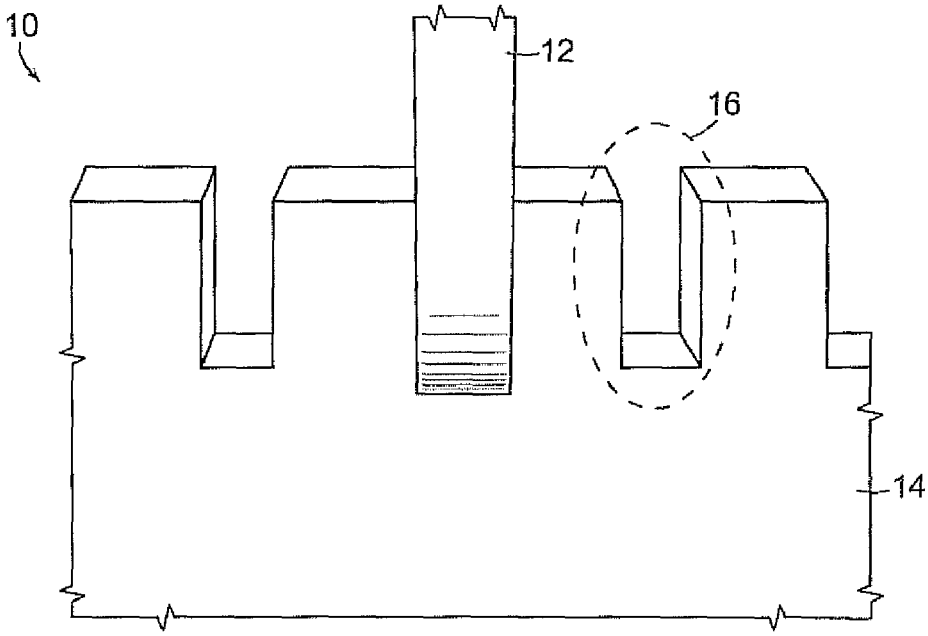
FIG. 1 is a schematic representation of a slot formation process of the invention.
Figure 2A:
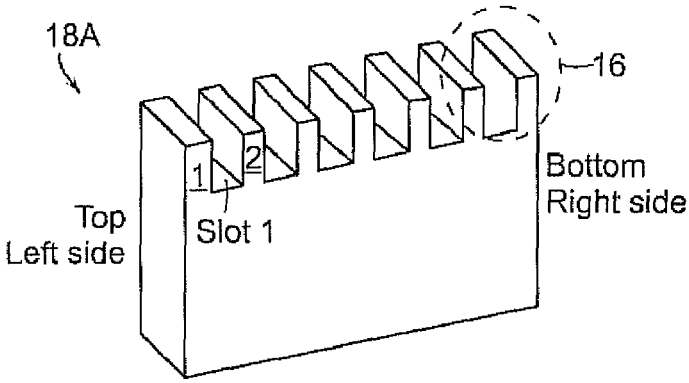
FIGS. 2(*a*) and 2(*b*) are schematic representation of slots that can be generated by the slot formation processes of the invention.
Figure 2B:
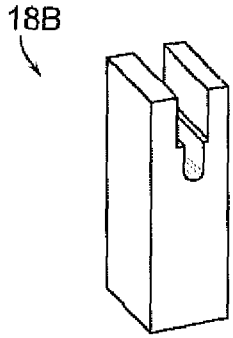

The slot formation processes of the invention remove the bulk of material, minimizing the amount of material to be removed in the complex shape grinding processes with a mounted point tool. As shown in FIG. 1, slot formation process 10 of the invention includes grinding workpiece 14 with at least one bonded abrasive tool 12, thereby forming slot(s) 16 in workpiece 14. FIGS. 2(*a*) and 2(*b*) show workpieces 18A and 18B that can be formed by the slot formation processes 10 of the invention, respectively. In one embodiment, slot 16 has a slot having a single diameter throughout the depths of the slot, as shown in FIG. 2(*a*). In another embodiment, slot 16 has a complex slot having at least two distinct diameters at different depths, as shown in FIG. 2(*b*). In some embodiments, the complex slot does not include a plurality of joined rectangular areas.

In one embodiment, the specific cutting energy for slot formation processes 10 of the invention is equal to, or less than, about 10 Hp/in$^3$·min (about 27 J/mm$^3$), such as between about 0.5 Hp/in$^3$·min (about 1.4 J/mm$^3$) and about 10 Hp/in$^3$·min (about 27 J/mm$^3$) or between about 1 Hp/in$^3$·min (about 2.7 J/mm$^3$) and about 10 Hp/in min (about 27 J/mm$^3$). In a specific embodiment, the specific cutting energy is between about 1 Hp/in$^3$·min (about 2.7 J/mm$^3$) and about 7 Hp/in$^3$·min (about 19 J/mm$^3$), such as between about 1 Hp/in$^3$·min (about 2.7 J/mm$^3$) and about 5 Hp/in$^3$·min (about 15 J/mm$^3$). In another specific embodiment, the specific cutting energy is between 4 Hp/in$^3$·min (about 11 J/mm$^3$) and about 10 Hp/in$^3$·min (about 27 J/mm$^3$), such as between about 4 Hp/in$^3$·min (about 10 J/mm$^3$) and about 7 Hp/in$^3$·min (about 19 J/mm$^3$).

In another embodiment, slot formation processes 10 of the invention are conducted at a material removal rate (MRR') in a range of between about 0.25 in$^3$/min·in (about 2.7 mm$^3$/sec/mm) and about 60 in$^3$/min·in (about 650 mm$^3$/sec/mm) and at a maximum specific cutting energy of about 10 Hp/in$^3$·min (about 27 J/mm$^3$), such as about 7 Hp/in$^3$·min (about 19 J/mm$^3$), or about 5 Hp/in$^3$·min (about 15 J/mm$^3$). Preferably, the material removal rate is in a range of between about 0.5 in$^3$/min·in (about 5 mm$^3$/sec/mm) and about 30 in$^3$/min·in (about 300 mm$^3$/sec/mm), such as between about 1 in$^3$/min·in (about 10 mm$^3$/sec/mm) and about 30 in$^3$/min·in (about 300 mm$^3$/sec/mm), or between about 5 in$^3$/min·in (about 50 mm$^3$/sec/mm) and about 30 in$^3$/min·in (about 300 mm$^3$/sec/mm).

In a specific embodiment, the slot formation processes of the invention are conducted at a material removal rate in a range of between about 5 in$^3$/min·in (about 50 mm$^3$/sec/mm) and about 30 in$^3$/min·in (about 300 mm$^3$/sec/mm) and at a specific cutting energy of between about 1 Hp/in$^3$·min (about 2.7 J/mm$^3$) and about 10 Hp/in$^3$·min (about 27 J/mm$^3$), such as between about 1 Hp/in$^3$·min (about 2.7 J/mm$^3$) and about 7 Hp/in$^3$·min (about 19 J/mm$^3$), between about 1 Hp/in$^3$·min (about 2.7 J/mm$^3$) and about 5 Hp/in$^3$·min (about 15 J/mm$^3$), between 4 Hp/in$^3$·min (about 11 J/mm$^3$) and about 10 Hp/in$^3$·min (about 27 J/mm$^3$), or between about 4 Hp/in$^3$·min (about 10 J/mm$^3$) and about 7 Hp/in$^3$·min (about 19 J/mm$^3$).

Alternatively, slot formation processes of the invention are conducted at a material removal rate (MRR') in a range of between about 2 mm$^3$/sec/mm and about 700 mm$^3$/sec/mm) and at a maximum specific cutting energy of about 30 J/mm$^3$. Preferably, the material removal rate is in a range of between about 5 mm$^3$/sec/mm and about 400 mm$^3$/sec/mm, such as between about 10 mm$^3$/sec/mm and about 400 mm$^3$/sec/mm or between about 30 mm$^3$/sec/mm and about 300 mm$^3$/sec/mm. Preferably, the maximum specific cutting energy is about 20 J/mm$^3$. In a specific embodiment, the specific cutting energy is between about 2 J/mm$^3$ and about 30 J/mm$^3$, such as between about 2 J/mm$^3$ and about 15 J/mm$^3$, or between about 10 J/mm$^3$ and about 30 J/mm$^3$, or between about 10 J/mm$^3$ and about 20 J/mm$^3$. In another specific embodiment, the slot formation processes of the invention are conducted at a material removal rate in a range of between about 50 mm$^3$/sec/mm and about 200 mm$^3$/sec/mm and at a specific cutting energy of between about 2 J/mm$^3$ and about 30 J/mm$^3$. In yet another specific embodiment, the slot formation processes of the invention are conducted at a material removal rate in a range of between about 50 mm$^3$/sec/mm and about 300 mm$^3$/sec/mm and at a specific cutting energy of between about 5 J/mm$^3$ and about 15 J/mm$^3$.

In a preferred embodiment, the slot formation processes of the invention are operated in a creep-feed grinding mode. More preferably, the creep-feed grinding is conducted at grinding speed in a range between about 30 m/s and about 150 m/s.

Any types of materials, including hard-to-grind materials, can be ground by the slot formation processes of the invention. The invention can be used to grind metallic workpieces having a hardness value of equal to or less than about 65 Rc, such as between about 4 Rc and about 65 Rc (or 84 to 111 Rb hardness). This is in contrast to prior art machining processes that typically can be used only for softer materials, i.e., those having a maximum hardness value of about 32 Rc. In one embodiment, the metallic workpieces for the invention have a hardness value of between about 32 Rc and about 65 Rc or between about 36 Rc and about 65 Rc. Specific examples of materials for the workpieces in the invention include titanium, Inconel (e.g., IN-718), steel-chrome-nickel alloys (e.g., 100 Cr6), carbon steel (AISI 4340 and AISI 1018) and combinations thereof.

In the slot formation processes of the invention, any types of bonded abrasive tools can be used, such as grinding wheels and cutoff wheels, which are comprised of a bond matrix, and at least about 3 volume % (on a tool volume basis) of a filamentary sol gel alpha-alumina abrasive grain, optionally including secondary abrasive grains or agglomerates thereof. Suitable methods for making bonded abrasive tools are disclosed in U.S. Pat. Nos. 5,129,919; 5,738,696; 5,738,697; 6,074,278; and 6,679,758 B, and U.S. patent application Ser. No. 11/240,809 filed Sep. 28, 2005, the entire teachings of which are incorporated herein by reference.

Preferably, a vitrified abrasive tool, preferably a vitrified abrasive wheel, is employed in the slot formation processes of the invention.

Preferably, the filamentary sol gel alpha-alumina abrasive grains for the invention comprise predominantly alpha alumina crystals having a size no greater than 1 micron.

A variety of examples of agglomerated abrasive grain granules can be found in U.S. Pat. No. 6,679,758 B2 and U.S. Patent Application Publication No. 2003/0194954, the entire teachings of which are incorporated herein by reference.

In one preferred embodiment, the bonded abrasive tools that can be used for the slot formation processes of the invention include a vitrified bond and from 3 to 43 volume %, on a tool volume basis, of a filamentary sol-gel alpha-alumina abrasive grain having an average length-to-cross-sectional-width aspect ratio of greater than about 4:1, preferably greater than 5:1, and most preferably at least 7.5:1, or an agglomerate thereof. Such grain and tools are described in U.S. Pat. No. 5,009,676 and U.S. Pat. No. 5,129,919.

In a specifically preferred embodiment, the bonded abrasive tools that can be used for the slot formation processes of the invention include a bond, preferably a vitrified bond, and at least about 3 volume % (on a tool volume basis) of a filamentary sol gel alpha-alumina abrasive grain having an average length-to-cross-sectional-width aspect ratio of at least 5:1 and comprises predominantly alpha alumina crystals having a size no greater than 1 micron.

In addition to filamentary grain, one or more of the abrasive grains known to be suitable for use in abrasive tools can be included in the bonded abrasive tools that are employed in the slot formation processes of the invention. Secondary grains may be present in amounts from 12 to 40 volume percent of the tool. Combined filamentary and secondary grains may be present in amounts of 15 to 43 volume percent of the tool. Examples of such abrasive grains include alumina grains, such as fused alumina, sol-gel sintered alumina, sintered bauxite, and the like; silicon carbide; alumina-zirconia, including cofused alumina-zirconina and sintered alumina-zirconina; aluminum oxynitride; boron suboxide; garnet; flint; diamond, including natural and synthetic diamond; cubic boron nitride (CBN); and combinations thereof. Additional examples of suitable abrasive grains include unseeded, sintered sol-gel alumina abrasive grains that include microcrystalline alpha-alumina and at least one oxide modifier, such as rare-earth metal oxides (e.g., $CeO_2$, $Dy_2O_3$, $Er_2O_3$, $Eu_2O_3$, $La_2O_3$, $Nd_2O_3$, $Pr_2O_3$, $Sm_3$, $Yb_2O_3$ and $Gd_2O_3$), alkali metal oxides (e.g., $Li_2O$, $Na_2O$ and $K_2O$), alkaline-earth metal oxides (e.g., MgO, CaO, SrO and BaO) and transition metal oxides (e.g., $HfO_2$, $Fe_2O_3$, MnO, NiO, $TiO_2$, $Y_2O_3$, ZnO and $ZrO_2$) (see, for example, U.S. Pat. Nos. 5,779,743, 4,314,827, 4,770,671, 4,881,951, 5,429,647 and 5,551,963, the entire teachings of which are incorporated herein by reference). Specific examples of the unseeded, sintered sol-gel alumina abrasive grains include rare-earth aluminates represented by the formula of $LnMAl_{11}O_{19}$, wherein Ln is a trivalent metal ion such as La, Nd, Ce, Pr, Sm, Gd, or Eu, and M is a divalent metal cation such as Mg, Mn, Ni, Zn, Fe, or Co (see, for example, U.S. Pat. No. 5,779,743). Such rare-earth aluminates generally have a hexagonal crystal structure, sometimes referred to as a magnetoplumbite crystal structure.

The bonded abrasive tools that can be used for the slot formation processes of the invention, have a combination of high mechanical strength and wear resistance along with a very open, permeable structure having interconnected porosity. In one embodiment, the bonded abrasive tools have at least about 35% porosity, preferably about 35% to about 80% porosity by volume of the tools. In another embodiment, at least about 30% by volume of the total porosity is interconnected porosity. Therefore, the bonded abrasive tools that can be used for the slot formation processes of the invention preferably have high interconnected porosity. Herein, the term "interconnected porosity" refers to the porosity of the abrasive tool consisting of the interstices between particles of bonded abrasive grain which are open to the flow of a fluid. The existence of interconnected porosity is typically confirmed by measuring the permeability of the abrasive tool to the flow of air or water under controlled conditions, such as in the test methods disclosed in U.S. Pat. Nos. 5,738,696 and 5,738,697, the entire teachings of which are incorporated herein by reference.

Examples of suitable bonded abrasive tools that can be used for the methods of the invention include ALTOS™ monolithic and OPTIMOS™ segmented abrasive rim grinding wheels, currently available from Saint-Gobain Abrasives in Worcester, Mass. ALTOS™ and OPTIMOS™ abrasive tools employ sintered sol gel alpha-alumina ceramic grains (Saint-Gobain Abrasives in Worcester, Mass.) with an average aspect ratio of about 8:1, such as Norton® TG2 or TGX Abrasives, as a filamentary abrasive grain. Single layer grain, metal bonded superabrasive grinding wheels, such as the electroplated or braze single layer CBN wheels of U.S. Pat. No. 6,883,234 B2 (i.e., carbon boron nitride plated or brazed to a steel tool core), are not generally suitable for use in a water-based coolant grinding process, such as the slotting step of the invention.

Herein, the term "filamentary" abrasive grain is used to refer to filamentary ceramic abrasive grain having a generally consistent cross-section along its length, where the length is greater than the maximum dimension of the cross-section. The maximum cross-sectional dimension can be as high as about 2 mm, preferably below about 1 mm, more preferably below about 0.5 mm. The filamentary abrasive grain may be straight, bent, curved or twisted so that the length is measured along the body rather than necessarily in a straight line. Preferably, the filamentary abrasive grain for the present invention is curved or twisted.

The filamentary abrasive grain for the bonded abrasive tools has an average aspect ratio of greater than 4:1, preferably at least 5:1, and most preferably at least about 7.5:1 and in a range of between about 5:1 and about 25:1. Herein, the "average aspect ratio" or the "length-to-cross-sectional-width-aspect ratio" refers to the ratio between the length along the principal or longer dimension and the greatest extent of the grain along any dimension perpendicular to the principal dimension. Where the cross-section is other than round, e.g., polygonal, the longest measurement perpendicular to the lengthwise direction is used in determining the aspect ratio.

The filamentary sol-gel alumina abrasive grain includes polycrystals of sintered sol-gel alpha-alumina. Seeded or unseeded sol-gel alpha-alumina can be included in the filamentary sol-gel alpha-alumina abrasive grain. Preferably, a filamentary, seeded sol-gel alpha-alumina abrasive grain is used for the blend of abrasive grains. In a preferred embodiment, the sintered sol-gel alpha-alumina abrasive grain includes predominantly alpha alumina crystals having a size of less than about 2 microns, more preferably no larger than about 1-2 microns, even more preferably less than about 1 micron, such as less than about 0.4 microns.

Sol-gel alpha-alumina abrasive grains can be made by the methods known in the art (see, for example, U.S. Pat. Nos. 4,623,364; 4,314,827; 4,744,802; 4,898,597; 4,543,107; 4,770,671; 4,881,951; 5,011,508; 5,213,591; 5,383,945; 5,395,407; and 6,083,622, the contents of which are hereby incorporated by reference.) For example, typically they are generally made by forming a hydrated alumina gel which may also contain varying amounts of one or more oxide modifiers (e.g., MgO, $ZrO_2$ or rare-earth metal oxides), or seed/nucleating materials (e.g. $\alpha$-$Al_2O_3$, $\gamma$-$Al_2O_3$, $\alpha$-$Fe_2O_3$ or chromium oxides), and then drying and sintering the gel (see for example, U.S. Pat. No. 4,623,364).

Typically, the filamentary sol-gel alpha-alumina abrasive grains can be obtained by a variety of methods, such as by extruding or spinning a sol or gel of hydrated alumina into continuous filamentary grains, drying the filamentary grains so obtained, cutting or breaking the filamentary grains to the desired lengths and then firing the filamentary grains to a temperature of, preferably not more then about 1500° C. Preferred methods for making the grain are described in U.S. Pat. No. 5,244,477, U.S. Pat. No. 5,194,072 and U.S. Pat. No. 5,372,620.

In another preferred embodiment, the bonded abrasive tools that can be used in the slot formation processes of the invention include a filamentary sol-gel alpha-alumina abrasive grain as described above, and further include agglomerated abrasive granules of abrasive grains. The abrasive grains of each granule of the agglomerated abrasive granules are held in a three-dimensional shape by a binding material. Herein, the term "agglomerated abrasive grain granules" or "agglomerated grain" refers to three-dimensional granules comprising abrasive grain and a binding material, the granules having at least 35 volume % porosity. Unless filamentary grains are described as making up all or part of the grain in the granules, the agglomerated abrasive grain granules consist of blocky or sphere-shaped abrasive grain having an aspect ratio of about 1.0. The agglomerated abrasive grain granules are exemplified by the agglomerates described in U.S. Pat. No. 6,679,758 B2. Various examples of blends of a filamentary sol-gel alpha-alumina abrasive grain and agglomerated abrasive granules of abrasive grains are disclosed in U.S. patent application Ser. No. 11/240,809 filed Sep. 28, 2005, the entire teachings of which are incorporated herein by reference.

Grain blends comprising filamentary abrasive grains, either in loose form and/or in agglomerated form, together with agglomerated abrasive grain granules comprising blocky or sphere-shaped abrasive grains having an aspect ratio of about 1.0 can be used for the bonded abrasive tools for the slot formation processes of the invention. In an alternative, the bonded abrasive tools for the slot formation processes of the invention are made with agglomerated filamentary abrasive grain granules.

For the bonded abrasive tools that can be employed in the slot formation processes of the invention, optionally one or more secondary abrasive grains in loose form can be included together with a filamentary sol-gel alpha-alumina abrasive grain as described above, or a blend of a filamentary sol-gel alpha-alumina abrasive grain and agglomerated abrasive granules of abrasive grains, as described above.

The secondary abrasive grain can include one or more of the abrasive grains known in the art for use in abrasive tools, such as the alumina grains, including fused alumina, non-filamentary sintered sol-gel alumina, sintered bauxite, and the like, silicon carbide, alumina-zirconia, aluminoxynitride, ceria, boron suboxide, garnet, flint, diamond, including natural and synthetic diamond, cubic boron nitride (CBN), and combinations thereof. Except when sintered sol-gel alumina is used, the secondary abrasive grain can be any shape, including filament-type shapes. Preferably, the secondary abrasive grain is a non-filamentary abrasive grain.

In one embodiment, the blend of a filamentary sol-gel alpha-alumina abrasive grain and agglomerated abrasive granules of abrasive grains, as described above, includes about 5-90%, preferably about 25-90%, more preferably about 45-80%, by weight of the filamentary sol-gel alpha-alumina abrasive grain with respect to the total weight of the blend. The blend further includes about 5-90%, preferably about 25-90%, more preferably about 45-80%, by weight, of the agglomerated abrasive grain granules. The blend optionally contains a maximum of about 50%, preferably about 25%, by weight of secondary abrasive grain that is neither the filamentary grain, nor the agglomerated grain. The selected quantities of the filamentary grain, the agglomerated grain and the optional secondary abrasive grain total 100%, by weight, of the total grain blend used in the abrasive tools of the invention.

The amounts of the filamentary abrasive grain in the agglomerate of the filamentary abrasive grain is typically in a range of about 15-95%, preferably about 35-80%, more preferably about 45-75%, by weight with respect to the total weight of the agglomerate.

The amount of the secondary abrasive grains in the agglomerate of the filamentary abrasive grain is typically in a range of about 5-85%, preferably about 5-65%, more preferably about 10-55%, by weight with respect to the total weight of the agglomerate. As in the case of blends of filamentary abrasive grain and agglomerated abrasive grain, optional secondary abrasive grain may be added to the agglomerated filamentary grain to form the total grain blend used in the abrasive tools of the invention. Once again, a maximum of about 50%, preferably about 25%, by weight, of the optional secondary abrasive grain may be blended with the filamentary grain agglomerate to arrive at the total grain blend used in the abrasive tools.

Any bond (binding) material typically used for bonded abrasive tools in the art can be used for the binding materials of the agglomerated abrasive grain granules and the agglomerate of filamentary sol-gel alpha-alumina abrasive grains. Preferably, the binding materials each independently include inorganic materials, such as ceramic materials, vitrified materials, vitrified bond compositions and combinations thereof, more preferably ceramic and vitrified materials of the sort used as bond systems for vitrified bonded abrasive tools. These vitrified bond materials may be a pre-fired glass ground into a powder (a frit), or a mixture of various raw materials such as clay, feldspar, lime, borax and soda, or a combination of fritted and raw materials. Such materials fuse and form a liquid glass phase at temperatures ranging from about 500 to about 1400° C. and wet the surface of the abrasive grain to create bond posts upon cooling, thus holding the abrasive grain within a composite structure. Examples of suitable binding materials for use in the agglomerates can be found, for example, in U.S. Pat. No. 6,679,758 B2 and U.S. Patent Application Publication No. 2003/0194954. Preferred binding materials are characterized by a viscosity of about 345 to 55,300 poise at about 1180° C., and by a melting temperature of about 800 to about 1300° C.

Any bond normally used in abrasive articles can be employed in the present invention. The amounts of bond and abrasive vary typically from about 3% to about 25% bond and about 10% to about 70% abrasive grain, by volume, of the tool. Preferably, the abrasive grains are present in the bonded abrasive tool in an amount of about 10-60%, more preferably about 20-52%, by volume of the tool. Also, when the agglomerate of filamentary sol-gel alpha-alumina abrasive grains is used without blending with the agglomerated abrasive granules, the amount of the agglomerate of filamentary sol-gel alpha-alumina abrasive grains are present in the bonded abrasive tool in an amount of about 10-60%, more preferably about 20-52%, by volume of the tool. A preferred amount of bond can vary depending upon the type of bond used for the abrasive tool.

In one embodiment, the abrasive tools of the invention can be bonded with a resin bond. Suitable resin bonds include phenolic resins, urea-formaldehyde resins, melamine-formaldehyde resins, urethane resins, acrylate resins, polyester resins, aminoplast resins, epoxy resins, and combinations thereof. Examples of suitable resin bonds and techniques for manufacturing such bonds can be found, for example, in U.S. Pat. Nos. 6,251,149; 6,015,338; 5,976,204; 5,827,337; and 3,323,885, the entire teachings of which are incorporated herein by reference. Typically, the resin bonds are contained in the compositions of the abrasive tools in an amount of about 3%-48% by volume. Optionally, additives, such as fibers, grinding aids, lubricants, wetting agents, surfactants, pigments, dyes, antistatic agents (e.g., carbon black, vanadium oxide, graphite, etc.), coupling agents (e.g., silanes, titanates, zircoaluminates, etc.), plasticizers, suspending agents and the like, can be further added into the resin bonds. A typical amount of the additives is about 0-70% by volume of the tool.

In another embodiment, the bond component of the tool comprises inorganic materials selected from the group consisting of ceramic materials, vitrified materials, vitrified bond compositions and combinations thereof. Examples of suitable bonds may be found in U.S. Pat. Nos. 4,543,107; 4,898,597; 5,203,886; 5,025,723; 5,401,284; 5,095,665; 5,711,774; 5,863,308; and 5,094,672, the entire teachings of all of which are incorporated herein by reference. For example, suitable vitreous bonds for the invention include conventional vitreous bonds used for fused alumina or sol-gel alpha-alumina abrasive grains. Such bonds are described in U.S. Pat. Nos. 5,203,886, 5,401,284 and 5,536,283, the entire teachings of all of which are incorporated herein by reference. These vitreous bonds can be fired at relatively low temperatures, e.g., about 850-1200° C. Other vitreous bonds suitable for use in the invention may be fired at temperatures below about 875° C. Examples of these bonds are disclosed in U.S. Pat. No. 5,863,308. Preferably, vitreous bonds which can be fired at a temperature in a range of between about 850° C. and about 1200° C. are employed in the invention. In one specific example, the vitreous bond is an alkali boro alumina silicate (see, for example, U.S. Pat. Nos. 5,203,886, 5,025,723 and 5,711,774).

The vitreous bonds are contained in the compositions of the abrasive tools typically in an amount of less than about 28% by volume, such as between about 3 and about 25 volume %; between about 4 and about 20 volume %; and between about 5 and about 18.5 volume %.

The bonded abrasive tools of the invention preferably contain from about 0.1% to about 80% porosity by volume of the tool. More preferably, they contain from about 35% to about 80% porosity by volume of the tool, and even more preferably they contain from about 40% to about 68% porosity by volume of the tool.

The bonded abrasive tools can be made by any suitable methods known in the art. For example, the blend of abrasive grains is then combined with a bond component. The combined blend of abrasive grains and bond component is molded into a shaped composite, for example, including at least about 35 volume percent porosity. The shaped composite of the blend of abrasive grains and bond component is heated to form the bonded abrasive tools.

The bonded abrasive tools may be mounted on conventional creepfeed grinding machines or other grinding machines designed to carry out high efficiency deep grinding processes, including multi-axis machining centers. With a multi-axis machining center, both the slot formation and the complex shape formation can be carried out on the same machine. Suitable grinding machines include, e.g., a Campbell 950H horizontal axis grinding machine tool, available from Campbell Grinding Company, Spring Lake, Mich., and a Blohm Mont. 408, three axis, CNC creep feed grinding machine, available from Blohm Maschinenbau GmbH, Germany.

Figure 3A:
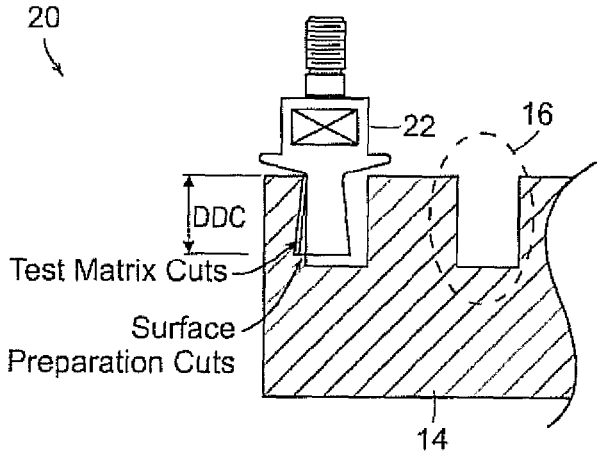
FIG. 3(*a*) is a schematic representation of a complex-shape formation process of the invention.
Figure 3B:
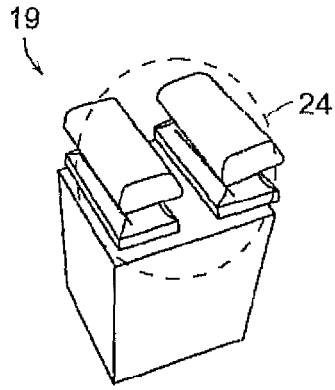

The slots produced by the slot formation processes of the invention, as described above, can be used for forming a complex shape in the slots, such as a re-entrant shape. As shown in FIG. 3(*a*), in one embodiment, complex shape formation processes 20 of the invention include grinding slot 16 of workpiece 14 with at least one mounted point tool 22 (or "quill") to produce a complex shape in workpiece 14. One example of complex shapes that can be produced by the methods of the invention is shown in FIG. 3(*b*) showing workpiece 19 having complex shape 24.

Figure 4A:
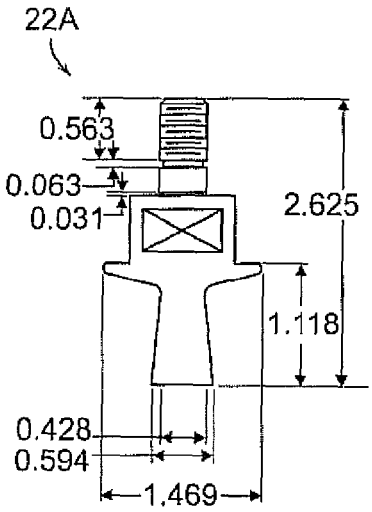
FIGS. 4(*a*) and 4(*b*) are schematic representation of mounted point tools that can be employed in the complex-shape formation processes of the invention.
Figure 4B:
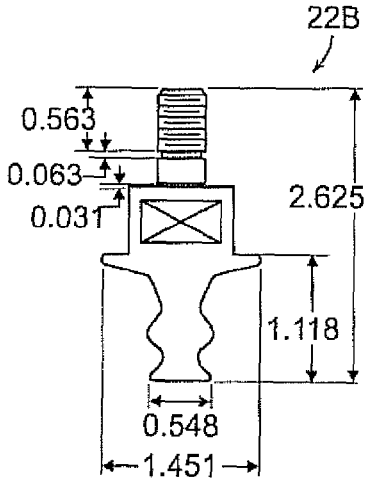

The shape of mounted point tool 22 can be any suitable shape for producing a desired complex shape 24, preferably a profiled shape. As used herein, the "profiled" means a shape having a variable dimension in cross-section. A profiled shape may be formed by the three-axis motion of a mounted point tool through a slot in a workpiece. In one embodiment, mounted point tool 22 has a shape that is the inverse of a complex shape, such as complex shape 24, to be imparted into workpiece 14, such as a turbine compressor disk. Specific examples of mounted point tools 22 (collectively referred to for mounted point tools 22A and 22B) are shown in FIGS. 4(*a*) and 4(*b*). Using a single CNC machine, such as a multi-axis machining center, one can carry out the step of forming a non-linear slot, followed by a step forming a re-entrant or a non-re-entrant profiled shape in the workpiece. Suitable grinding machines include various Makino grinding and milling machines available from Makino Milling Machine Company, Ltd., Mason, Ohio.

Mounted point tools 22 can include any abrasive grains suitable for use in the abrasive tools known in the art. Examples of abrasive grains are as described above. Preferably, mounted point tools 22 include a superabrasive grain. In a more preferred embodiment, mounted point tools 22 include at least one superabrasive grain selected from the group consisting of diamond and cubic boron nitride. In an even more preferred embodiment, mounted point tool 22 is an electroplated mounted point tool that includes at least one of diamond and cubic boron nitride.

In some embodiments, the complex shape formation processes 20 are performed in a single step using a single mounted point tool 22. In other embodiments, complex shape formation processes 20 are performed in at least two steps using more than two mounted point tools 22. In a specific embodiment, complex shape formation processes 20 include: i) roughly grinding slot 16 with a first mounted point tool; and ii) finishing the roughly-ground slot with a second mounted point tool. Preferably, the second mounted point tool contains an abrasive grain having a smaller grit size than the first mounted point tool. For example, the first mounted point tool includes about 301 microns abrasive grains and the second mounted point tool includes about 181 microns abrasive grains or 91 microns abrasive grains.

In a preferred embodiment, complex shape formation processes 20 of the invention are conducted at a material removal rate in a range of between about 0.01 $in^3$/min·in (about 0.1 $mm^3$/sec/mm) and about 0.5 $in^3$/min·in (about 5 $mm^3$/sec/mm), such as between about 0.01 $in^3$/min·in (about 0.1 $mm^3$/sec/mm) and about 0.3 $in^3$/min·in (about 3 $mm^3$/sec/mm) or between about 0.03 $in^3$/min·in (about 0.3 $mm^3$/sec/mm) and about 0.2 $in^3$/min·in (about 2 $mm^3$/sec/mm). In another preferred embodiment, complex shape formation processes 20 of the invention are conducted at a specific cutting energy of less than about 15.0 Hp/$in^3$·min (about 41 J/$mm^3$), such as less than about 13.0 Hp/$in^3$·min (about 36 J/$mm^3$) or between about 10.0 Hp/$in^3$·min (about 27 J/$mm^3$) and about 13.0 Hp/$in^3$·min (about 36 J/$mm^3$).

Alternatively, complex shape formation processes 20 of the invention are conducted at a material removal rate in a range of between about 0.1 $mm^3$/sec/mm and about 6 $mm^3$/sec/mm, such as between about 0.1 $mm^3$/sec/mm and about 4 $mm^3$/sec/mm or between about 0.3 $mm^3$/sec/mm and about 3 $mm^3$/sec/mm. In another preferred embodiment, complex shape formation processes 20 of the invention are conducted at a specific cutting energy of less than about 50 J/$mm^3$, such as less than about 40 J/$mm^3$ or between about 20 J/$mm^3$ and about 40 J/$mm^3$.

For each of slot formation processes 10 and point grinding processes 20, coolant can optionally be provided to the grinding zone between abrasive tool 12 and workpiece 14 (see FIG. 1) and/or to the grinding zone between point mounted tool 22 and slotted workpiece 14 (see FIG. 3(*a*)). Applying a coolant to the grinding zone(s) can minimize a thermal damage in the workpiece being ground. Preferably, the applied coolant is in the form of a coherent jet, as described in U.S. Pat. No. 6,669,118 B2, the entire teachings of which are incorporated herein by reference. Coherent jets of coolant can be provided through one or more modular nozzles that are configured (e.g., sized and shaped) to provide such coherent jets. In one embodiment, one modular nozzle is independently employed for the slot formation and point grinding processes. In another embodiment, two modular nozzles are independently employed for the slot formation and point grinding processes. When two modular nozzles are employed, the two modular nozzles are preferably used on opposing sides so that the direction of flow is with the direction of rotation of the bonded abrasive tool or point mounted tool for each side of the tool.

Typically, coherent jets of coolant are applied to the grinding zone(s) in a nominally tangential direction at a predetermined temperature, pressure and flowrate. Generally, the temperature, pressure and flowrate are each independently chosen depending upon operation parameters for the specific grinding processes (i.e., the slot formation and/or the complex-shape formation processes), such as grinding speeds, material removal rates and specific cutting energy. A desired flowrate of coolant for a grinding operation and a desired coolant pressure required to generate a coolant jet speed that matches the grinding wheel speed can be determined by methods known in the art, for example by the methods described in U.S. Pat. No. 6,669,118 B2. Also, a nozzle discharge area capable of achieving the flowrate at the pressure, and a suitable nozzle configuration can be determined by methods known in the art, for example by the methods described in U.S. Pat. No. 6,669,118 B2.

In one embodiment, the flowrate of coolant applied to a grinding zone is determined either using the width of the grinding zone or by using the power being consumed by the grinding process. For example, 25 GPM per inch (4 liters per minute per mm) of grinding wheel contact width is generally effective in many grinding applications. Alternatively, a power-based model of 1.5 to 2 GPM per spindle horsepower (8-10 liters per min per KW) may be more accurate in many applications, since it corresponds to the severity of the grinding operation. Also, the coolant jet may optimally be adjusted to reach the grinding zone at a velocity that approximates that of the grinding surface of the grinding wheel. This grinding wheel speed may be determined empirically, i.e., by direct measurement, or by simple calculation using the rotational speed of the wheel and the wheel diameter. The pressure required to create a jet of known velocity may be determined using an approximation of Bernoulli's equation. A range of modular nozzle configuration can be used in the invention to apply coherent jets of coolant, such as rectangular nozzles and round nozzles. In one specific embodiment, for the slot formation processes of the invention, a round nozzle is employed, such as a round nozzle with a 0.280" aperture.

Coolants that can be used in the invention include water-based coolants and water-soluble oil-based coolants. In a preferred embodiment, a water-soluble oil is used for the coolant. Specific examples of the water-soluble oils include Oel-Held Rotorol SYN Amine free, 3% oil concentration, applied at 78 GPM (L/Min.) of flow rate and at 152 PSI (Kg/$mm^2$) pressure using a nozzle with 12 mm diameter orifice, designed for internal coherent flow. Also useful in the process of the invention are various commercial water-based metal working fluids for machining and grinding applications that are available from Castrol (BP Lubricants, USA, Inc.), Wayne, N.J., Master Chemical Co., Perrysburg, Ohio, and other suppliers.

The complex shape produced by the methods of the invention can be included in various machine tool parts, gears, automotive components, heavy equipments, off high way machinery parts, and aerospace and land based turbines, such as mounting slots in rotors, vanes, blades, casings and IBRs. In a preferred embodiment, the complex shape produced by the methods of the invention is a re-entrant shape of a turbine or compressor of an engine.

In the two-step grinding process of the invention, the initial slotting step with the selected bonded abrasive wheels can be carried out at specific cutting energies similar to those of traditional milling operations. Multiple passes may be carried out with a single wheel to achieve deep slots. This is in contrast to the multi-step slotting operations carried out with a plurality of superabrasive wheels described in U.S. Pat. No. 6,883,234 B2. Also in contrast to traditional milling or broaching machining operations, with the slot grinding method of the invention, high MRRs can be achieved very simply with a mounted grinding wheels and a water-based oil coolant and without the time consuming and complex tool set-ups needed to achieve similar MRRs in machining operations. These benefits can be achieved on a variety of difficult to finish workpiece materials, including hardened or soft nickel alloys, titanium alloys and various types of steel (e.g., 100Cr6, 52100 and 4340 steel) in various hardness grades.

Examples of specific cutting energies and material removal rates (MRR') expected in the initial slotting step of the process of the invention and various prior art slotting steps are listed in Table 1. These operational parameters are expected in conditions where water-soluble oil coolants are used and the tools are operated without inducing work piece damage, such as burn or severe adverse residual workpiece stress or severe tool wear conditions.

TABLE 1

| Tool Type | Workpiece (hardness) | Slot Formation: Specific Cutting Energy[a] HP/in$^3$/min | MRR' In$^3$/Min./In. | Specific Cutting Energy[a] J/mm$^3$ | MRR' mm$^3$/mm./sec. |
|---|---|---|---|---|---|
| Milling tool[b] | Nickel alloy (In 718, Rb 94) | 1.5-2.5 | 0.1-1.0 | 4.1-6.8 | 1-10 |
| Milling tool[b] | 100Cr6 Steel | 0.9-1.08 | 4.0-25 | 2.45-2.94 | 4-250 |
| Milling tool[b] | 4340 steel | 0.9-1.08 | 4.0-25 | 2.45-2.94 | 4-250 |
| Invention Grinding wheel with filamentary abrasive grain[c] | Nickel alloy (In 718, Rb 190) | 25 | 5-15 | 5.5-14 | 50-150 |
| Invention Grinding wheel with filamentary abrasive grain[c] | Nickel alloy (In 718, Re 43) | 1.5-5 | 10-20 | 4-14 | 100-200 |
| Invention Grinding wheel with filamentary abrasive grain[c] | 100Cr6 steel (Rc 32) | 2-5 | 5-30 | 5.5-14 | 50-300 |
| Invention Grinding wheel with filamentary abrasive grain[c] | 4340 steel (48 Re) | 1-7 | 10-20 | 2.73-19 | 100-200 |
| Invention Grinding wheel with filamentary abrasive grain[c] | 4340 steel (Rb 217) | 4.0-7.0 | 5 to 10 | 11-19 | 50-100 |
| Invention Grinding wheel with filamentary abrasive grain[c] | 1018 Steel (Rb 87) | 5-10 | 5-15 | 14-27 | 50-150 |
| Comparative Metal bonded CBN grain grinding wheel[d] | Nickel alloy (In 718) | 10-30 | 5-30 | 27-82 | 50-300 |
| Comparative Vitrified bond CBN grain grinding wheel[e] | Nickel alloy (In 718) | 10-40 | 5-10 | 27-109 | 50-100 |

[a]The specific cutting energy (SCE) is the slope of a linear plot of power versus material removal rate (MRR).
[b]Milling data is adapted from Machinery's Handbook, 26th Edition, 2000 and other cutting tool industry sources.
[c]Representative grinding wheels with filamentary abrasive grain useful in this slot formation grinding process are those vitrified bonded wheels made with 3 to 43 volume % TGX alumina grain (120 grit size; average aspect ratio of ~8:1) obtained from Saint-Gobain Ceramics & Plastics, Inc., Worcester, MA. Various representative commercial wheels (e.g., Altos ™ and Optimos ™ wheels, such as TGX120-H12-VCFS and TGX 120-F 12-VCF5) are suitable for use in the invention and are available from Saint-Gobain Abrasives, Inc., Worcester, MA.
[d]Representative single layer CBN grain, metal bonded, slotting tools are described in U.S. Pat. No. 6,883,234 B2.
[e]Comparative grinding wheels containing CBN grain in a vitrified bond sold for use in slot grinding are available from Saint-Gobain Abrasives, Inc., Worcester, MA. (e.g., BBD120-E128VCF10 CBN wheels)

Having carried out the initial slotting step by a grinding operation at a low specific cutting energy, in the second step of the process of the invention, shaped profile superabrasive tools, as illustrated in FIGS. 3(*a*), 4(*a*) and 4(*b*), can be used to create the desired complex shape. An example of suitable commercially-available mounted point tool is an electroplated CBN grain tool, e.g., SN1503 mounted point tool with a grit size of 301 μm, available from Saint-Gobain Abrasives, Travelers Rest, S.C. Typically, a complex shape is formed using one or more electroplated or brazed CBN superabrasive grain mounted point tools, as shown in FIG. 3(*a*), in a variety of difficult to finish workpiece materials, including hardened or soft nickel alloys, titanium alloys and various types of steel (e.g., 100Cr6, 52100 and 4340 steel) in various hardness grades. In a preferred embodiment, the slot formation step is carried out at a lower specific cutting energy than that for the complex-shape formation step. Specific examples of the suitable specific cutting energies are as described above.

Larger abrasive grits on the mounted point tool result in rougher final surface finishes. Surface finish of the complex-shape formation processes can be tailored by controlling operating conditions, e.g., roughly grinding a pre-slot and then finishing the roughly-ground pre-slot with a mounted point tool having a fine grit size to form a complex shape with good surface finish.

Typical shaping grinding conditions for progressively finer surface finishes are shown in Table 2 below. Three runs are performed for each material at increasing depths of cut (DOC), 0.05", 0.100" and 0.150" (about 1.25, about 2.0 and about 3.75 mm). These DOC are chosen based on predicted power draws. All runs are performed at 0.6 ipm (about 15 mm/min). A coherent jet of QuakerCool® 27778 water-based coolant is introduced into the grinding zone during the grinding processes at a pressure of 100 psi (pressure at pump) and a flow rate of 15 gpm.

TABLE 2

Grinding Conditions for mounted point shaping step

| Run | Grit Size (μm) | Feed Rate (ipm) | DOC (in) | Wheel Speed (rpm) |
|---|---|---|---|---|
| 1 | 301 | 0.6 | 0.0050 | 60,000 |
| 2 | 301 | 0.6 | 0.100 | 60,000 |
| 3 | 181 | 0.6 | 0.150 | 60,000 |

Expected specific cutting energy (SCE) results with an SN1503 mounted point tool having the grit size of 301 μm are summarized in Table 3. As shown in Table 3, the expected SCE for the AISI 4340 material is the smallest with SCE of 11. The expected SCE for the In-718 Inconel material is the largest with SCE of 13. The expected SCEs for both AISI 1018 and 100 Cr6 materials are in the middle with SCEs of 12. Such SCEs are generally acceptable for formation of complex shapes at the MRR's given in Table 3.

TABLE 3

Specific Cutting Energy and Material Removal Rates (MRR') for the Step of Grinding Complex Shapes into Pre-ground Slots to Form Re-entrant Shapes

| Materials | Specific Cutting Energy ($HP/in^3/min$) | Specific Cutting Energy ($J/mm^3$) | MRR' ($in^3$/min/in) | MRR' $mm^3$/sec/mm) |
|---|---|---|---|---|
| IN-718 Inconel | 13 | 35.0 | 0.045-0.122 | 0.48-1.3 |
| 100 Cr6 steel | 12 | 33.1 | 0.045-0.122 | 0.48-1.3 |
| AISI 4340 steel | 11 | 29.5 | 0.045-0.122 | 0.48-1.3 |
| AISI 1018 steel | 12 | 32.0 | 0.045-0.122 | 0.48-1.3 |

EQUIVALENTS

While this invention has been particularly shown and described with references to preferred embodiments thereof, it will be understood by those skilled in the art that various changes in form and details may be made therein without departing from the scope of the invention encompassed by the appended claims.

What is claimed is:

1. A method of producing a complex shape in a workpiece, comprising the steps of:

a) grinding a workpiece at a maximum specific cutting energy within a range between about 1 $Hp/in^3$ min (about 2.7 $J/mm^3$) and 7 $Hp/in^3$ min (about 19 $J/mm^3$) at a material removal rate in a range between about 5 $in^3$/min·in (about 50 $mm^3$sec/mm) and about 30 $in^3$/min·in (about 300 $mm^3$/sec/mm) with at least one bonded abrasive wheel, thereby forming a slot in the workpiece, wherein the bonded abrasive wheel contains at least about 3 volume % of a filamentary sol-gel alpha-alumina abrasive grain having an average length-to-cross-sectional-width aspect ratio of greater than about 4:1 or an agglomerate thereof, and wherein during grinding to form the slot, a coherent jet of water-soluble oil coolant is applied to the workpiece and bonded abrasive wheel; and b) grinding the slot with at least one mounted point tool.

2. The method of claim 1, wherein the bonded abrasive wheel includes at least about 35 volume percent porosity.

3. The method of claim 2, wherein the bonded abrasive wheel includes between about 35 and about 80 volume percent porosity.

4. The method of claim 1, wherein the bonded abrasive tool is a vitrified abrasive wheel.

5. The method of claim 4, wherein the workpiece is ground to form a complex slot having two distinct diameters at different depths.

6. The method of claim 5, wherein the complex shape produced by the method is a re-entrant shape.

7. The method of claim 6, wherein the complex shape produced by the method is a re-entrant shape of a turbine or compressor of an engine.

8. The method of claim 1, wherein the filamentary sol-gel alpha-alumina abrasive grain has an average aspect ratio of at least about 5:1 and comprises predominantly alpha alumina crystals having a size no greater than 1 micron.

9. The method of claim 8, wherein the bonded abrasive tool further includes agglomerated abrasive granules of abrasive grains, wherein the abrasive grains of each granule are held in a three-dimensional shape by a binding material.

10. The method of claim 1, wherein the point tool includes a superabrasive grain.

11. The method of claim 1, wherein the point tool includes at least one superabrasive grain selected from the group consisting of diamond and cubic boron nitride.

12. The method of claim 11, wherein the point tool is a profiled mounted point tool.

13. The method of claim 1, wherein the step of grinding the slotted workpiece with at least one point tool includes:

a) roughly grinding the slot with a first mounted point tool; and b) finishing the roughly-ground slot with a second mounted point tool.

14. The method of claim 13, wherein the second mounted point tool contains an abrasive grain having a smaller grit size than the first mounted point tool.

15. The method of claim 1, further comprising the step of providing a coherent jet of coolant to a grinding zone between the abrasive tool and workpiece or to a grinding zone between the point tool and slotted workpiece, or to both of the grinding zones.

16. The method of claim 1, wherein the step of forming the slot in the workpiece is a creep-feed grinding operation.

17. The method of claim 16, the creep-feed grinding is conducted at a grinding speed in a range of between about 30 m/s and about 150 m/s.

18. The method of claim 1, wherein step a) comprises grinding the workpiece within a range between about 1 $Hp/in^3$ min (about 2.7 $J/mm^3$) and about 5 $Hp/in^3$ min (about 15 $J/mm^3$) at a material removal rate in a range between about 5 $in^3$/min·in (about 50 $mm^3$sec/mm) and about 30 $in^3$/min·in (about 300 $mm^3$/sec/mm).

* * * * *